US006147588A

United States Patent [19]

Nakayama et al.

[11] Patent Number: 6,147,588

[45] Date of Patent: Nov. 14, 2000

[54] MATERIAL AND PASTE FOR PRODUCING INTERNAL ELECTRODE OF VARISTOR, LAMINATED VARISTOR, AND METHOD FOR PRODUCING THE VARISTOR

[75] Inventors: Akinori Nakayama, Ostu; Ryouichi Urahara, Yokaichi; Yukio Sakabe, Kyoto, all of Japan

[73] Assignee: Murata Manufacturing Co., Ltd., Japan

[21] Appl. No.: 09/271,605

[22] Filed: Mar. 17, 1999

[30] Foreign Application Priority Data

Mar. 17, 1998 [JP] Japan ..... 10-066858

[51] Int. Cl.[7] ..... H01C 7/13

[52] U.S. Cl. ..... 338/21; 252/514

[58] Field of Search ..... 338/21, 20; 252/514

[56] References Cited

U.S. PATENT DOCUMENTS

| | | | |
|---|---|---|---|
| 3,789,516 | 2/1974 | Short | 252/514 |
| 3,964,906 | 6/1976 | Kenney | 427/301 |
| 4,290,041 | 9/1981 | Utsumi et al. | 338/21 |
| 4,529,835 | 7/1985 | Mizuno | 361/305 |
| 4,552,691 | 11/1985 | Shoji et al. | 252/514 |
| 4,655,892 | 4/1987 | Satta et al. | 204/192.15 |
| 4,835,508 | 5/1989 | Seike et al. | 338/21 |
| 4,877,854 | 10/1989 | Hattori et al. | 528/15 |
| 5,678,168 | 10/1997 | Brown et al. | 252/514 |
| 5,687,055 | 11/1997 | Miki | 252/514 |
| 5,787,866 | 8/1998 | Sugiyama et al. | 427/344 |
| 5,976,420 | 11/1999 | Nakamura et al. | 338/21 |

*Primary Examiner*—Karl D. Easthom
*Attorney, Agent, or Firm*—Ostrolenk, Faber, Gerb & Soffen, LLP

[57] ABSTRACT

The present invention provides a varistor which has low variation in electric characteristics and enhanced withstand electrostatic voltage and which can be fired at low temperature; as well as a method for producing the same. The laminated varistor comprises a sintered laminate formed by laminating alternating layers of semiconducting ceramic which comprises ZnO as a primary component and at least Bi oxide as a secondary component, and internal electrodes which predominantly comprise Pt and Pd as an inevitable impurity; and external electrodes maintaining electrical contact with the internal electrodes, wherein the Pd content is controlled to be about 0.1 wt. % or less based on the content of Pt, which is a primary component of the internal electrodes.

2 Claims, 1 Drawing Sheet

MATERIAL AND PASTE FOR PRODUCING INTERNAL ELECTRODE OF VARISTOR, LAMINATED VARISTOR, AND METHOD FOR PRODUCING THE VARISTOR

BACKGROUND OF THE INVENTION

1. Field of the Invention

The present invention relates to a laminated varistor, and more particularly, to a laminated varistor including a semiconducting ceramic which comprises ZnO as a primary component and at least Bi oxide as a secondary component, and internal electrodes which predominantly comprise Pt. The present invention also relates to a method for producing the laminated varistor. The invention further relates to a material and a paste for producing internal electrodes of a varistor, the material and the paste having reduced Pd content.

2. Background Art

Recently, the field of electronic elements employed in communication devices and the like has seen rapid progress in miniaturization and in lowering of driving voltage. Without exception, varistors must be miniaturized so as to enhance the packaging density thereof and must be driven at low voltage. In order to satisfy these demands, Japanese Patent Application Laid-Open (kokai) No. 5-283208 discloses a laminated varistor.

The above-mentioned laminated varistor includes a laminate formed by laminating alternating layers of semiconducting ceramic which contains ZnO as a primary component and at least Bi oxide as a secondary component, and internal electrodes which predominantly comprise Pt; and then firing the laminated product at 1000° C. or higher, wherein external electrodes are formed on two side faces of the laminate such that each of the internal electrodes has one end exposed to one of the side faces so as to establish electric contact with one of the external electrodes. In the laminated varistor, semiconducting ceramic grains are grown such that the grain size is approximately equal to the distance between adjacent internal electrodes. Thus, voltage nonlinearity of the varistor is basically developed from interface between one semiconducting ceramic layer and one internal electrode.

However, laminated varistors having conventional internal electrodes formed of Pt have disadvantageously variable electric characteristics, i.e., irregular variation of voltage nonlinearity and withstand voltage against electrostatic discharge.

These variable electric characteristics are attributed to formation of Pd-Bi-O having high electric resistance. Pd is an inevitable impurity in the Pt and originates from materials for producing internal electrodes of varistors.

Although a varistor including internal electrodes formed of Pt containing no Pd theoretically exhibits excellent electric characteristics, the sintering temperature of such internal electrodes is as high as 1200° C., i.e., an advantageous low-temperature firing is not attained.

SUMMARY OF THE INVENTION

In view of the foregoing, an object of the present invention is to provide a material for producing internal electrodes of a varistor, wherein the material not only prevents formation of Pd-Bi-O having high electric resistance during high-temperature sintering but can be sintered at low temperature.

Another object of the present invention is to provide a paste for producing internal electrodes of a varistor, wherein the paste not only prevents formation of Pd-Bi-O having high electric resistance during high-temperature sintering but can be sintered at low temperature.

Still another object of the present invention is to provide a laminated varistor produced by use of a material for producing internal electrodes, the material having a reduced Pd content.

Yet another object of the present invention is to provide a method for producing a laminated varistor.

Accordingly, in a first aspect of the present invention, there is provided a material for producing internal electrodes of a varistor, which material comprises Pt and Pd, the amount of Pd being more than 0 wt. % and about 0.1 wt. % or less based on the amount of Pt.

In a second aspect of the present invention, there is provided a paste for producing internal electrodes of a varistor, which paste comprises Pt powder, an organic Pt compound, an organic vehicle, and an organic solvent, wherein Pd is contained in an amount of more than 0 wt. % and about 0.1 wt. % or less based on the amount of Pt.

In a third aspect of the present invention, there is provided a laminated varistor comprising a sintered laminate formed of laminating alternating layers of semiconducting ceramic which comprises ZnO as a primary component and at least Bi oxide as a secondary component, and internal electrodes which predominantly comprise Pt and Pd as an inevitable impurity; and external electrodes maintaining electrical contact with the internal electrodes, wherein the Pd content is controlled to be about 0.1 wt. % or less based on the content of Pt which is a primary component of the internal electrodes.

Preferably, in the above laminated varistor, the external electrodes contain Ag.

In a fourth aspect of the present invention, there is provided a method for producing a laminated varistor comprising the following steps:

- fabricating ceramic green sheets comprising ZnO as a primary component and at least Bi oxide as a secondary component;
- preparing a paste for producing internal electrodes wherein the Pd content is controlled;
- forming internal electrodes by applying the above paste containing Pd in an amount of about 0.1 wt. % or less to each of the above ceramic green sheets through printing;
- laminating the ceramic green sheets on which internal electrodes are formed, such that one of the ceramic green sheets and one of the internal electrodes are brought into contact;
- firing the produced laminate to provide a sintered laminate; and
- forming external electrodes on the sintered laminate.

Preferably, in the above method, the green sheets further contain $Co_2O_3$.

Preferably, in the above method, the green sheets further contain MnO.

Preferably, in the above method, the green sheets further contain $Sb_2O_3$.

Preferably, in the above method, the green sheets further contain $B_2O_3/SiO_2/ZnO$ glass.

Preferably, in the above method, the firing temperature is approximately 1200° C.

Preferably, in the above method in which the firing temperature is approximately 1200° C., the firing time is approximately three hours.

In the above four aspects of the present invention, there can be attained prevention of reaction between Bi oxide and Pd and improvement in voltage nonlinearity and withstand electrostatic voltage.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with accompanying drawings, in which.

DETAILED DESCRIPTION OF THE INVENTION

The material and the paste for producing internal electrodes of a varistor according to the present invention contain Pd in an amount of more than 0 wt. % and about 0.1 wt. % or less based on the amount of Pt, whereas conventionally employed materials for producing internal electrodes contain Pd as an inevitable impurity in Pt in an amount of 1 wt. % or more based on Pt.

When a laminated varistor including a semiconducting ceramic which comprises ZnO as a primary component and at least Bi oxide as a secondary component is produced from conventionally employed pastes, the Bi oxide in the semiconducting ceramic reacts with Pd in the internal electrodes at 1000° C. or higher to thereby form Pd-Bi-O, which has a high electric resistance. The oxide causes irregular variation in voltage nonlinearity and withstand electrostatic voltage.

The paste for producing internal electrodes of a varistor according to the present invention contains an organic Pt compound as well as Pt powder. The Pt organic compound prevents delamination during firing of a laminate.

The present invention will next be described by way of examples, which should not be construed as limiting the invention thereto.

EXAMPLES

ZnO, $Bi_2O_3$, $Co_2O_3$, MnO and $Sb_2O_3$ were weighed so as attain the respective contents of 96.5 mol %, 1.0 mol %, 1.0 mol %, 1.0 mol %, and 0.5 mol %. To the weighed mixture, a glass powder formed of $B_2O_3$, $SiO_2$ and ZnO was added in an amount of 1.0 wt. %.

Subsequently, the resultant mixture was wet-mixed for 12 hours by use of a ball mill employing zirconia grinding balls and calcined at 700° C. for two hours. The calcined product was milled again for 12 hours by use of a ball mill. The milled product was mixed with an organic binder formed of a butyral resin to form a slurry, which was then formed by use of a doctor blade into a sheet having a thickness of 20 $\mu$m. The sheet was punched to a predetermined size to thereby obtain ceramic green sheets.

Figure 2:
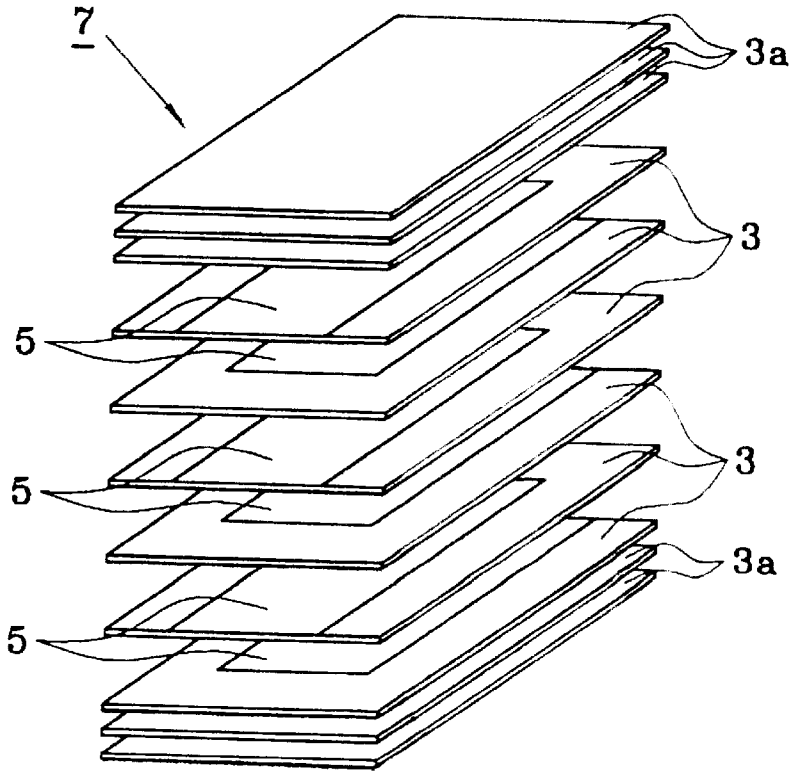
FIG. 2 is a fragmentary perspective view of a laminate of a laminated varistor according to the present invention.

Subsequently, a paste for producing internal electrodes was prepared by mixing Pt powder, an organic Pt compound, an organic vehicle and a solvent. Any convenient organic Pt compound, organic vehicle and solvent can be used. As shown in FIG. 2, the paste was applied onto ceramic green sheets 3 through printing to thereby form internal electrodes 5. The Pd content of the paste for producing internal electrodes was quantitatively determined relative to the content of Pt after the paste as such was heated at 500° C. to burn the organic component out.

Lamination was performed such that alternating layers of the ceramic green sheets 3 and the internal electrodes 5 were laminated and alternating internal electrodes 5 were located on one edge while the remaining internal electrodes were located on another edge. The upper surface and the lower surface of the laminate were laminated with a plurality of ceramic green sheets 3*a* serving as outer surfaces. The laminated product was pressed in a direction perpendicular to the green sheets and electrodes at 2 ton/cm$^2$ to thereby obtain a laminate 7, which was fired in air at 1200° C. for three hours to obtain a sintered laminate formed of semiconducting ceramic layers 4 and internal electrodes 5.

Figure 1:
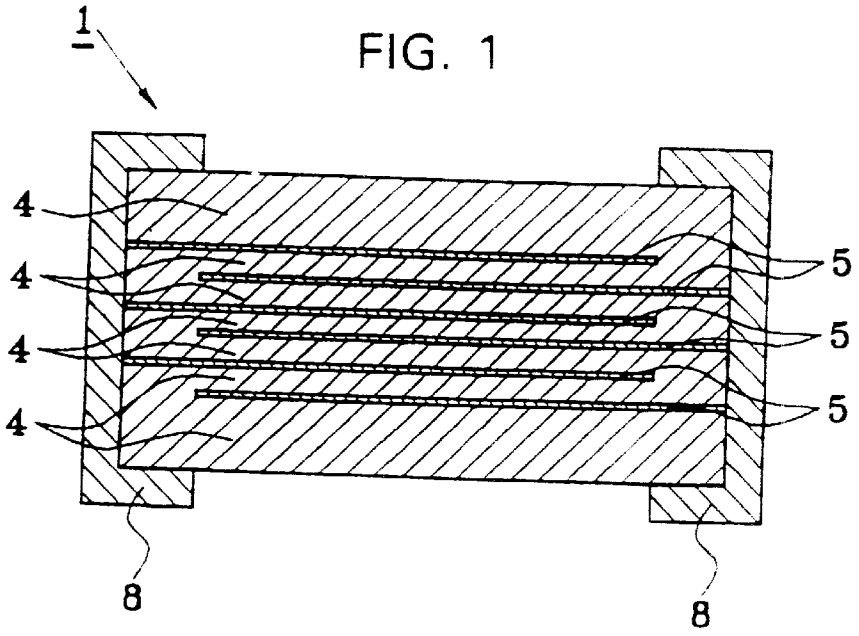
FIG. 1 is a cross-sectional view of a laminated varistor according to the present invention.

Furthermore, as shown in FIG. 1, an Ag paste was applied to exposed faces of the internal electrodes 5 of the sintered laminate and burnt at 600° C. for 10 minutes to thereby form external electrodes 8. Thus, a varistor 1 was obtained.

The thus-obtained varistors having various Pd contents were subjected to measurement of varistor voltage ($V_{1mA}$), voltage nonlinearity coefficient ($\alpha$), insulation resistance (IR), and withstand electrostatic voltage. The results are shown in Table 1. Samples marked with * fall outside the scope of the present invention. In the measurements, IR refers to resistance when 50% of the corresponding varistor voltage is applied, and withstand electrostatic voltage refers to a maximum electrostatic voltage below which variation of the corresponding varistor voltage falls within ±10% after 10 applications of an electrostatic pulse according to IEC801-2 at intervals of 1 second.

TABLE 1

| Sample No. | Pd content in internal electrodes (wt. %) | Varistor voltage ($V_{1\ mA}$) | Voltage nonlinearity coefficient $\alpha$ | Insulation resistance IR (MΩ) | Withstand electrostatic voltage (kV) |
|---|---|---|---|---|---|
| 1 | 0.001 | 3.9 | 57 | 1.28 | 30 |
| 2 | 0.012 | 3.9 | 57 | 1.25 | 28 |
| 3 | 0.057 | 3.9 | 58 | 1.3 | 28 |
| 4 | 0.085 | 3.9 | 57 | 1.24 | 30 |
| *5 | 0.103 | 4.1 | 41 | 2.74 | 8 |
| *6 | 0.508 | 4.2 | 37 | 2.97 | 6 |

As confirmed in Table 1, when the Pd content of the internal electrodes is about 0.1 wt. % or less, withstand electrostatic voltage increases remarkably.

When the Pd content is in excess of 0.1 wt. %, as in the case of Samples 5 and 6, varistor voltage ($V_{1mA}$) increases, insulation resistance decreases and withstand electrostatic voltage decreases remarkably. These disadvantages are the reasons why the Pd content in internal electrodes is limited to about 0.1 wt. % or less in the laminated capacitor and the method for producing the same according to the present invention.

In the laminated capacitor and the method for producing the same according to the present invention, the content of Pd—which is an impurity in the internal electrode—based on that of Pt is about 0.1 wt. % or less. Therefore, a substance having an interface of high electric resistance is formed by reaction between Bi oxide and Pd is not formed at an interface between one semiconducting ceramic sheet and one internal electrode, and, in particular, withstand electrostatic voltage increases remarkably. In addition, in the present invention, since the Pd content of the internal electrode is constant, internal electrodes can be fired at approximately 1000° C. and a laminated capacitor having constant electric characteristics can be obtained.

What is claimed is:

1. A laminated varistor comprising a sintered laminate of alternating layers of semiconducting ceramic which comprises ZnO and Bi oxide, and internal electrodes which comprise Pt and Pd wherein the Pd content is a positive amount of about 0.1 wt. % or less based on the content of Pt; and external electrodes maintaining electrical contact with the internal electrodes.

2. A laminated varistor according to claim 1, wherein the external electrodes comprise Ag.

* * * * *